US009617712B2

(12) United States Patent
Steff de Verninac et al.

(10) Patent No.: US 9,617,712 B2
(45) Date of Patent: Apr. 11, 2017

(54) METHOD FOR DETERMINING THE POSITION OF A CUTTING DEVICE IN THE GROUND USING A MOBILE CARRIAGE

(71) Applicant: SOLETANCHE FREYSSINET, Rueil Malmaison (FR)

(72) Inventors: Bertrand Steff de Verninac, Rueil Malmaison (FR); Daniel Perpezat, Rueil Malmaison (FR); Jean-Pierre Hamelin, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 11 days.

(21) Appl. No.: 14/761,638

(22) PCT Filed: Jan. 20, 2014

(86) PCT No.: PCT/FR2014/050102

§ 371 (c)(1),
(2) Date: Jul. 17, 2015

(87) PCT Pub. No.: WO2014/114867

PCT Pub. Date: Jul. 31, 2014

(65) Prior Publication Data

US 2015/0345108 A1 Dec. 3, 2015

(30) Foreign Application Priority Data

Jan. 23, 2013 (FR) ..... 13 50581

(51) Int. Cl.
*E02F 5/08* (2006.01)
*E02F 5/20* (2006.01)
(Continued)

(52) U.S. Cl.
CPC ..... *E02F 5/145* (2013.01); *E02F 3/181* (2013.01); *E02F 3/205* (2013.01); *E02F 3/26* (2013.01); *E02F 5/08* (2013.01); *E21B 47/024* (2013.01)

(58) Field of Classification Search
CPC ... E02F 3/181; E02F 3/26; E02F 3/205; E02F 5/08; E02F 5/20; E02F 5/145
(Continued)

(56) References Cited

U.S. PATENT DOCUMENTS 3,491,842 A * 1/1970 Castela ..... E21B 7/124 175/171
4,202,416 A * 5/1980 Blaschke ..... E21B 4/18 173/33
(Continued)

FOREIGN PATENT DOCUMENTS

EP 0841465 A1 5/1998
FR 2211027 A5 7/1974
(Continued)

*Primary Examiner* — Gary Hartmann
(74) *Attorney, Agent, or Firm* — MH2 Technology Law Group, LLP

(57) ABSTRACT

An excavator machine that includes components such as: a suspended casing having a top end and a bottom end; at least one cable that extends above the casing, where the cable is under tension and has a bottom end that is fastened to the top end of the casing; and a cutter device that is arranged at the bottom end of the casing. The excavator machine further includes: a carriage that is mounted to slide along the cable; a device for moving the carriage along the cable; and a locator device for determining the three-dimensional position of the carriage.

20 Claims, 6 Drawing Sheets

(51) Int. Cl.

| | |
|---|---|
| ***E02F 5/14*** | (2006.01) |
| ***E02F 3/18*** | (2006.01) |
| ***E02F 3/26*** | (2006.01) |
| ***E21B 47/024*** | (2006.01) |
| ***E02F 3/20*** | (2006.01) |

(58) Field of Classification Search
USPC ..... 37/91, 92, 93, 94, 95, 189
See application file for complete search history.

(56) References Cited

U.S. PATENT DOCUMENTS

| | | | | |
|---|---|---|---|---|
| 3,010,214 | A | 8/1984 | Postelwaite | |
| 4,770,255 | A * | 9/1988 | Barthelemy | E21B 4/00 175/6 |
| 5,056,242 | A * | 10/1991 | Miotti | E02D 17/13 37/195 |
| 6,839,989 | B2 * | 1/2005 | Gessay | E02D 17/13 175/107 |
| 8,065,813 | B2 * | 11/2011 | Siepi | E02D 3/126 33/302 |
| 9,353,501 | B2 * | 5/2016 | Halkyard | E02F 3/905 |
| 2009/0158623 | A1 * | 6/2009 | Chagnot | E02D 5/18 37/94 |

FOREIGN PATENT DOCUMENTS

| | | | |
|---|---|---|---|
| JP | H07-11650 | A | 1/1995 |
| JP | H07-734771 | A | 2/1995 |

* cited by examiner

METHOD FOR DETERMINING THE POSITION OF A CUTTING DEVICE IN THE GROUND USING A MOBILE CARRIAGE

BACKGROUND OF THE INVENTION

The present invention relates to the fields of boring and of making excavation screens in the ground.

More precisely, the invention relates to an excavator machine comprising:

- a suspended casing having a top end and a bottom end;
- at least one cable extending above the casing, said cable being under tension and having a bottom end fastened to the top end of the casing; and
- a cutter device arranged at the bottom end of the casing.

Such an excavator machine may particularly, but not exclusively, be a rotary drum boring machine, also referred to as a hydraulic cutter. FR 2 211 027 describes such a machine. During the boring operation, the casing moves downwards progressively as the rotary drums dig the trench.

In another variant, such an excavator machine is a clamshell bucket, actuated by a mechanical or hydraulic mechanism.

For certain kinds of work, the trench may present a great depth, possibly reaching 100 meters (m) or even more. Furthermore, it is generally necessary for such a trench to present great accuracy in terms of verticality, in particular because the final work is the result of juxtaposing panels, e.g. molded walls or any other type of screen.

In particular because of irregularities in the soil in which the trench is to be made, there are major risks of the casing being deflected from its vertical path, and this risk increases with increasing boring depth.

There thus exists a real need to have systems making it possible to monitor verticality, or at least orientation, concerning the movements of the casing in the ground, by detecting any offsets from the desired path.

To solve that problem, EP 0 841 465 proposes a system of monitoring the verticality of a boring machine in which two cables of small section are fastened to the top end of the machine. The cables are kept under constant tension and pass through two fixed reference points arranged at the top end of the trench. By continuously measuring the lengths of the cables, and also the tilt angles at the ends of the cables that are fastened to the machine, it is possible to calculate the coordinates of the two cable fastener points.

Although that method gives satisfaction for boring depths of less than 100 m, it nevertheless is not sufficiently accurate for boring the greater depths.

OBJECT AND SUMMARY OF THE INVENTION

An object of the invention is to propose an excavator machine having a system for monitoring the path followed by the casing that provides results that are accurate, regardless of the depth of boring.

The invention achieves this object by the fact that the excavator machine further comprises:

- a carriage that is mounted to slide along the cable;
- a device for moving the carriage along the cable; and
- a locator device for determining the three-dimensional position of the carriage.

The carriage is distinct from the casing and is thus configured to move along the cable, which cable may be a carrier cable from which the casing is suspended and that has the function of carrying the casing, or else it may be a non-carrier cable that is provided specially for guiding the carriage. The carriage preferably moves between the surface and the bottom end of the cable.

The cable is under tension. When the cable is a carrier cable, it can be understood that it is tensioned by the action of the weight of the casing. When the cable that is used for guiding the movement of the carriage is not a carrier cable, then the machine includes means for keeping the cable under tension.

In practice, the cable under tension is rarely accurately rectilinear. It presents a shape that is curved to a greater or lesser extent depending on the path followed by the casing during boring. In Document EP 0 841 465, it is assumed to a first approximation that the cables are rectilinear, which makes it possible to obtain results that are acceptable so long as the depth of the boring is small. Nevertheless, it can be understood that for greater depths, that approximation no longer holds since the cables may present significant curvature.

By moving along the cable, the carriage follows the curvature of the cable. Consequently, knowledge of the three-dimensional position of the carriage makes it possible to determine the three-dimensional position of the cable, and in particular the position of the bottom end of the cable, thus making it possible to determine the position of the casing and the position of the cutter device, given the length and the tilt of the casing.

Preferably, the carriage moves down under the effect of its own weight. It might possibly be ballasted. To raise the casing, the movement means preferably include a connection cable that is itself connected to a winch. In another variant, the carriage has a motor-driven wheel for moving it along the cable.

The three-dimensional position of the carriage is preferably determined several times over as it moves along the cable. The term "measurement point" is used to designate each of the successive positions of the carriage along the cable at which measurements are taken in order to determine the three-dimensional positions of said carriage.

The term "three-dimensional position" is used to mean in particular the extent to which the carriage has turned relative to a reference position, and also its position along the cable. The measurements may be taken while the carriage is moving down, or while it is moving up.

In order to improve the accuracy of results, a first series of measurements is taken while the carriage is moving down, and a second series of measurements is taken while the carriage is moving up, with the position of the casing being determined using both the first and the second series of measurements.

Advantageously, in order to further improve the accuracy of results, the carriage is held stationary at each measurement point so that the measurements are taken while the carriage is stopped.

Generally, the casing is suspended via a plurality of carrier cables. Without going beyond the ambit of the present invention, the carriage may be slidably mounted on one or another of the carrier cables.

In a variant, in order to improve the accuracy of results, the carriage is moved along one of the carrier cables and measurements of position are taken along that cable, and then the carriage, or another similar carriage, is moved along another one of the carrier cables, and position measurements are taken along that other cable.

Advantageously, the carriage is configured so that its path runs locally along the axis of the cable along which it is moving. For this purpose, the carriage is preferably provided with three wheels that clamp onto the cable.

Advantageously, the excavator machine of the invention further comprises a guide device for preventing the carriage from pivoting about the cable as it moves along said cable. This makes it possible to improve the accuracy of measurements significantly, since pivoting of the carriage around the cable would have the consequence of falsifying the measurements.

In order to avoid such pivoting, the casing is preferably fastened to the bottom end of a first cable and to the bottom end of a second cable, the carriage is mounted to slide along the first cable, and the guide device comprises at least one arm secured to the carriage and co-operating at least with the second cable, without adding stress.

An advantage of this configuration is to be able to detect and measure twisting of the path of the casing.

Once the first and second cables present angular movement, when considered in a substantially horizontal plane, that is associated with the casing turning about a vertical axis, it can be understood that the carriage is caused by its arm to follow the same angular movement.

Preferably, the arm has a distal end that cooperates with the second cable. This distal end is preferably, but not necessarily, provided with at least one roller having its axis of rotation substantially perpendicular to the second cable so as to facilitate sliding of the arm along the second cable.

In a variant, the excavator machine of the invention further comprises an extractor pipe for extracting cuttings, which pipe extends above the casing, and the arm is curved so as to be spaced apart from the extractor pipe. An advantage is to avoid contact between the arm and the extractor pipe, which might otherwise block or slow down the movement of the carriage.

Advantageously, the locator device includes at least one device for measuring tilt that is arranged in the carriage.

A plurality of measurements are thus taken of the tilt of the carriage as the carriage moves along the cable. As mentioned above, these measurements are taken while the carriage is moving down and/or while it is moving up.

Advantageously, the measurements are taken at depths that are predetermined, or indeed at predetermined travel distances of the carriage along the cable.

In a preferred embodiment, the locator device has first and second devices for measuring tilt that are arranged in the carriage and that are arranged to measure tilt angles in two mutually perpendicular vertical planes.

Thus, by taking a succession of measurements of the tilt of the carriage in the two vertical planes, it is possible by using an integral calculus method, to determine the position of the bottom end of the cable, and thus the coordinates of one of the points at the top end of the casing. The calculation is also based on the distance traveled by the carriage between two successive measurements.

Advantageously, but not necessarily, the machine of the invention further comprises guide means arranged above the surface of the ground in order to hold stationary in a horizontal plane the zone of the cable that lies in that plane while the casing is moving progressively downwards, the guide means serving to define at least one fixed reference point so that the position of the bottom end of the cable is determined relative to the fixed reference point.

Preferably, the guide means make it possible to define as many fixed reference positions as there are cables. Also preferably, the guide means comprise stationary guide means through which the cables pass, said stationary guide means being arranged at the surface of the ground in a horizontal plane facing the trench.

The guide means thus serve to simplify calculation. Nevertheless, they may be omitted. Under such circumstances, it is necessary also to take account of the movement in a horizontal plane situated at the surface of the zone of the cable that is situated in said horizontal plane. For example, when the excavator machine of the invention is a clamshell bucket, which is periodically raised to the surface each time its buckets are full of cuttings, it is not possible to install the guide means.

Advantageously, by taking the same type of measurements while causing the carriage to travel along another cable, it is possible to determine the coordinates of another point at the top end of the casing.

In order to improve measurement accuracy, the twist angle of the path followed by the carriage is determined at the same time as its tilt angles are measured. To do this, the locator device further comprises a device for measuring the angle of rotation of the carriage in a plane substantially perpendicular to the cable.

This pivoting, also referred to as twisting, contributes to calculating the three-dimensional location of the carriage.

In a preferred embodiment, the carriage has a memory for storing the data measured by the locator device during the movement of the carriage. This data is then transferred to calculation means located at the surface, which transfer preferably takes place when the carriage is raised to the surface. In a variant, the transfer takes place in real time via the connection cable.

Advantageously, the locator device further comprises a device for determining the length of the movement of the carriage along said cable. Preferably, the device for determining the length the carriage has moved along the cable determines the length of connection cable that has been unwound.

In preferred manner, the means for moving the carriage are configured so that the downward and/or upward speed of the carriage along the cable is controlled.

According to the invention, the excavator machine further comprises a device for determining the position of the casing from the measurement data taken by the locator device during the movement of the carriage along the cable. This device performs a calculation step that uses all of the measurements taken to determine the coordinates of at least the bottom end of one of the cables fastened to the top end of the casing.

In order to position the cutter device, the casing includes an inclinometer enabling the tilt of the casing to be measured relative to the vertical, and the machine also comprises a device for determining the position of the cutter device from the position, the length, and the tilt of the casing.

In another variant, the machine also includes a conventional pulley block pivotally mounted on the top end of the casing to pivot relative to the longitudinal axis of the casing. The machine also has means for measuring the angle of rotation of the pulley block relative to the casing. In this variant, the cables are connected to the pivotally-mounted pulley block so that the casing can pivot relative to the cables. The position of the cutter device is then determined in the same manner as above, except that use is also made of the angle of rotation of the pulley block as provided by the measurement means.

The present invention also relates to a method of boring in soil, which method comprises the following steps:

- providing an excavator machine of the invention;
- performing a boring step by causing the casing to penetrate into the soil;

performing a step of moving the carriage along the cable, during which step the three-dimensional positions of the carriage are measured at different measurement points; and determining the position of the casing in the soil from the position measurements of the carriage.

Advantageously, in order to improve the accuracy of measurements, the carriage is held stationary at each measurement point while the three-dimensional position of the carriage is being measured. Naturally, it is nevertheless also possible to take measurements on the fly, without stopping the carriage.

Preferably, the movement of the carriage is stopped at each measurement point for the time required to measure its three-dimensional position. By way of example, the carriage may be held stationary once every 0.5 m, 1 m, or 2 m of the cable.

Preferably, the cable is held stationary prior to performing the step of moving the carriage, and a plurality of steps of moving the carriage are performed during the boring step so as to determine a plurality of positions of the casing in the soil and so as to obtain the real path followed by the casing in the soil. The cable may be held stationary by stopping downward movement of the casing, for example.

Advantageously, mathematical processing of the position measurements of the carriage, and preferably integration processing, is performed in order to determine the coordinates of at least the bottom end of the cable that is fastened to the top portion of the casing. These coordinates are preferably coordinates relative to the above-mentioned fixed reference position. Preferably, in order to improve the accuracy of measurements, a plurality of steps are performed of moving the carriage along the same cable. Also preferably, in certain steps of moving the carriage along the same cable, the sensors are turned through 180° in order to cancel out calibration errors.

In a variant, steps are performed of moving the carriage along other cables in order to determine the coordinates of the bottom ends of other cables that are fastened to the top portion of the casing. This makes it possible in particular to recalculate the distances between the cables in order to verify that they do indeed coincide with the real distances. An advantage is thus to check the quality of the measured values. Another advantage is to determine the rotation of the top portion of the casing relative to the horizontal.

Advantageously, the tilt of the casing is measured and the position of the cutter device in the soil is determined from the position of the casing and the measured tilt of the casing.

In a particularly advantageous implementation, the real path followed is compared with a path that is predetermined for the casing in the soil, and the positioning of the casing is corrected during the boring step in order to minimize the offset between the real path and the predetermined path. This positioning correction is performed by means of actuators arranged on the casing and controlled from the surface. In known manner, these actuators are constituted by pads driven by hydraulic means serving to exert thrust on the walls of the trench in order to modify the path followed by the casing.

Advantageously, the real path followed by the cutter device is determined, and this is preferably compared with a predetermined path in order to correct for any detected deflection.

Finally, the invention provides the carriage that is to be slidably mounted on a cable connecting the surface to the excavator machine of the invention.

BRIEF DESCRIPTION OF THE DRAWINGS

The invention can be better understood on reading the following description of an embodiment given by way of non-limiting example and with reference to the accompanying drawings, in which.

DETAILED DESCRIPTION OF THE INVENTION

Figure 1:
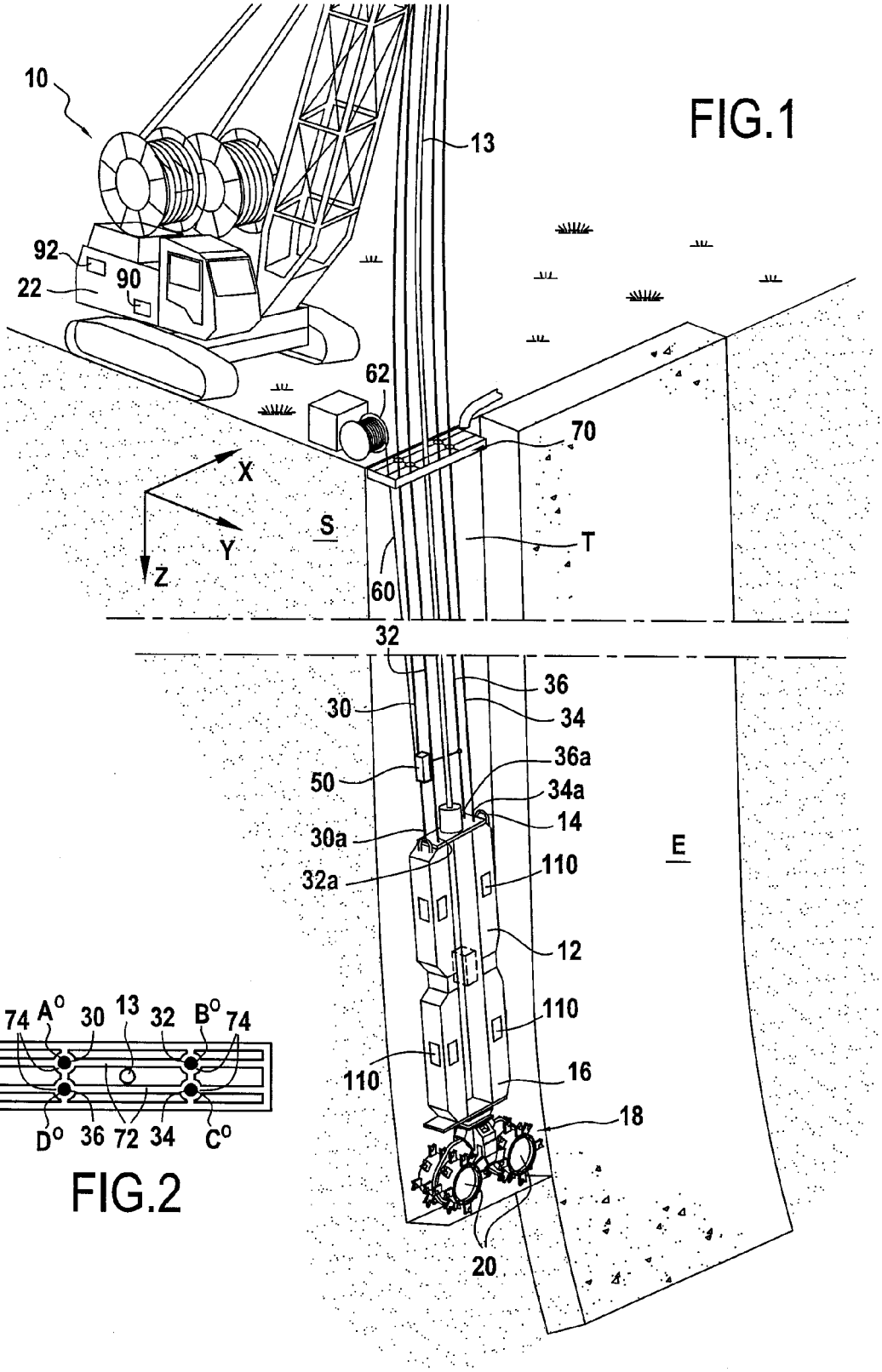
FIG. 1 is an overall view of the excavator machine of the invention while boring.
Figure 2:
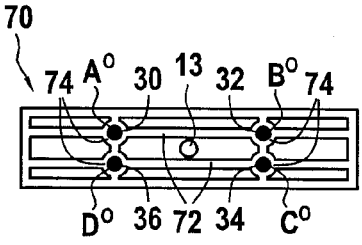
FIG. 2 is a plan view of guide means for placing in a horizontal plane at the surface facing the trench.

FIG. 1 shows an excavator machine 10 in accordance with the present invention while boring a trench T in soil S adjacent to a screen E already in place in the soil.

In the description below, the term "thickness" designates the short dimension of the trench T considered in a horizontal plane, and the term "width" designates the long dimension of the trench T considered in a horizontal plane. The term "depth" designates the height of trench considered in a vertical direction.

Finally, the description refers to an orthogonal reference frame X, Y, Z, where X is an axis parallel to the width of the trench, Y is an axis parallel to the thickness of the trench, and Z is a downwardly-oriented vertical axis.

In this example, the excavator machine 10 is a hydraulic cutter. The excavator machine comprises a suspended casing 12 having a top end 14 and a bottom end 16.

The casing extends in a longitudinal direction DL and presents a length L.

A cutter device 18, having rotary drums 20, is fastened to the bottom end 16 of the casing 12.

In conventional manner, the casing 12 is suspended from a hoist 22. For this purpose, in this non-limiting example, the excavator machine has first, second, third, and fourth carrier cables referenced 30, 32, 34, and 36. Each cable has a bottom end 30*a*, 32*a*, 34*a*, or 36*a* that is fastened to the top end 14 of the casing. The fastener points of the cables 30, 32, 34, and 36 to the top portion of the casing are referenced A, B, C, and D. In known manner, the top ends of the cables are mounted on one or more drums carried by the hoist 22.

The cables are carrier cables in the sense that they carry the casing 12. It should be understood that the cables are tensioned by the action of the weight of the casing. It should also be understood that the cables extend above the casing 12.

The excavator machine 10 also has a pipe 13 for extracting cuttings, which pipe extends above the casing, being connected to the top end 14 of the casing. As can be seen in FIG. 1, the carrier cables 30, 32, 34, and 36 are arranged around the pipe 13 for extracting cuttings and they extend substantially parallel thereto.

In accordance with the present invention, the excavator machine 10 has a carriage 50 that is mounted to slide along the first cable 30. As explained above, the carriage 50 can also be configured to slide along any of the other three cables 32, 34, and 36.

Figure 10:
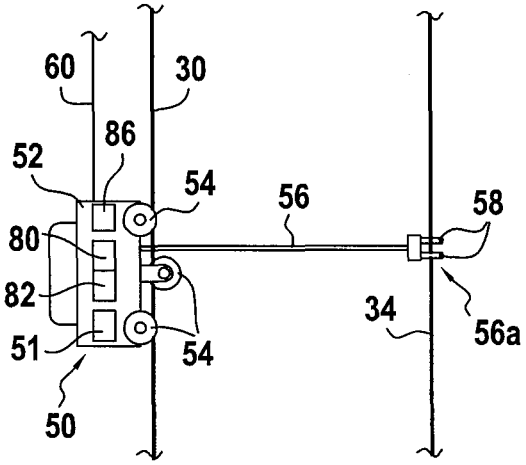
FIG. 10 is a detail view of the carriage.

The carriage 50, shown in FIG. 10, comprises a body 52 having three wheels 54 fastened thereto that enable the carriage 50 to slide along said cable 30. The wheels 54 are arranged on opposite sides of the cable so as to clamp onto it, thereby enabling the carriage 50 to slide along the cable.

In this example, the movement of the carriage 50 along the first cable 30 is driven by a device comprising a connection cable 60 connected to the body 52 and also to a drum 62 at the surface. Although the carriage can move down along the cable under the action of its own weight, its downward speed is nevertheless controlled by the action of the drum 62.

The drum 62 also has a function of raising the carriage 50 at controlled speed.

In order to avoid the carriage 50 pivoting about the cable 30 while it is moving, a guide device 56 is provided that comprises an arm 56 that is secured perpendicularly to the body 52, and that co-operates with another cable, specifically the cable 34 in this example. The first and second cables are situated in the same half-thickness of the casing, but not in the same half-width of the casing.

The arm 56 has a distal end **56*a* co-operating with the second cable. In this example, the distal end 56*a* has two rollers 58 with axes of rotation that are substantially parallel to the arm and serving to minimize friction between the arm and the second cable 34**.

In the example shown in FIG. 1, the arm 56 is curved so as to be spaced apart from the extraction pipe 13. This serves to avoid any risk of the arm coming into contact with the extraction pipe, which would impede or block movement of the carriage.

Figure 3:
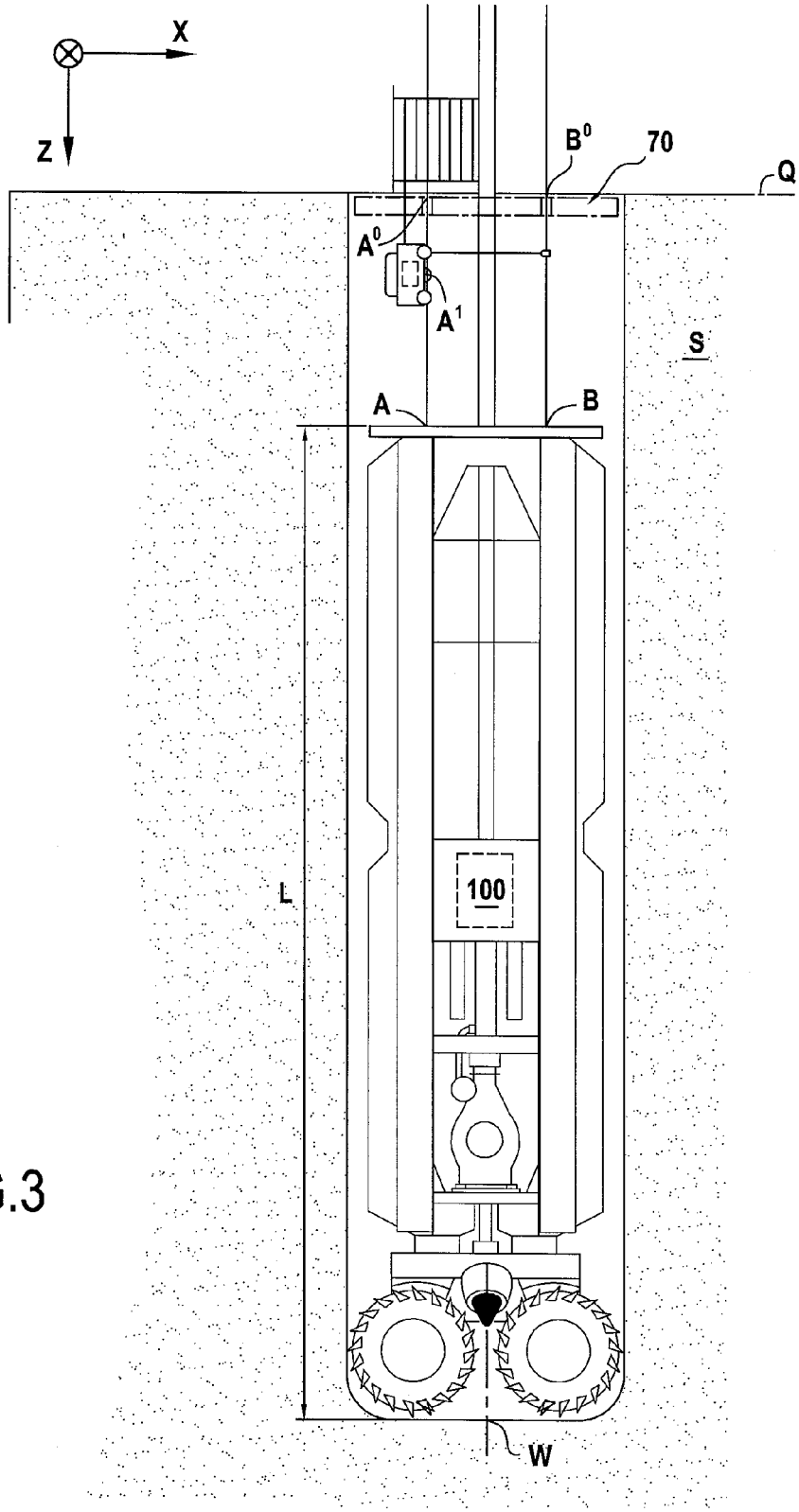
FIG. 3 shows the beginning of the boring operation, the casing being shown in front view, in a plane orthogonal to the thickness of the trench, the casing being oriented vertically.
Figure 4:
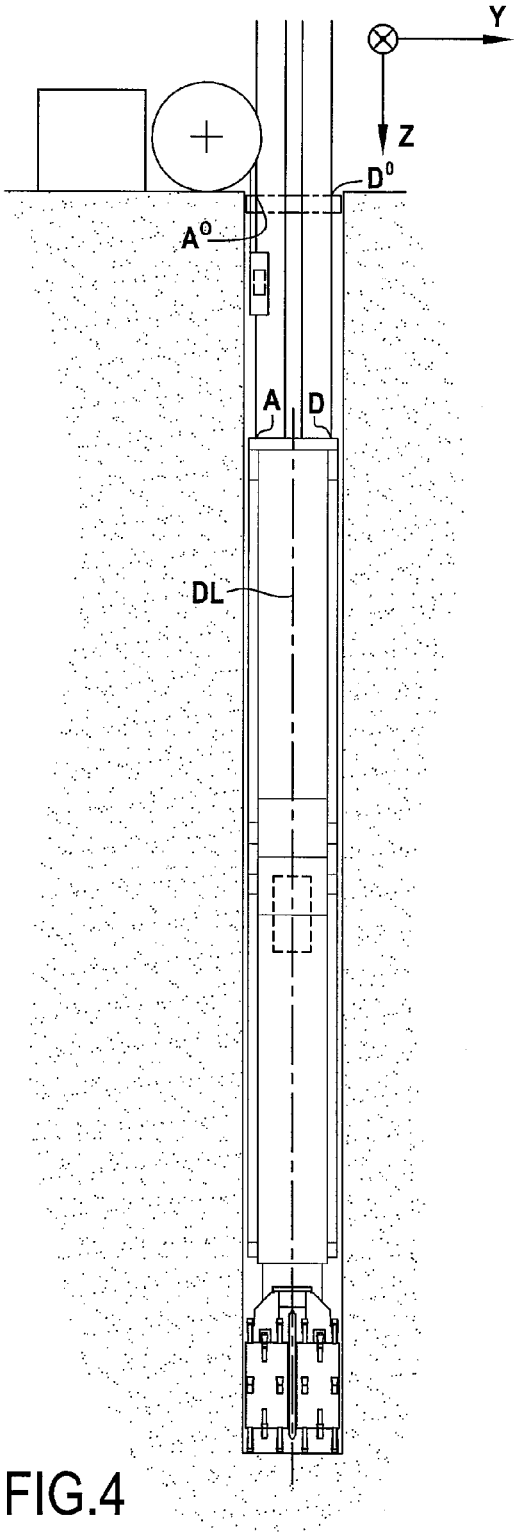
FIG. 4 is a side view of the FIG. 3 casing.

In this embodiment, the excavator machine 10 also has guide means 70 for guiding the first, second, third, and fourth cables 30, 32, 34, and 36. These guide means 70 are constituted by cross-bars 72 holding four guide rings 74 in position for guiding the cables. As can be seen in FIG. 3, the guide means 70 are positioned at the surface and their function is to hold in position in a horizontal plane Q the zones of the cables that are located in the horizontal plane Q.

During the boring operation, as described below, the guide means are fastened relative to the ground so that the carrier cables remain fixed in position in the horizontal plane Q. The guide rings 74 could naturally be of some other shape, defining four fixed reference positions referred to as $A^0$, $B^0$, $C^0$, and $D^0$. The positions of the rings preferably coincide with the positions of the fastener points A, B, C, and D when the top end of the casing is situated substantially in the horizontal plane Q.

It can be understood that the guide means ensure that the reference points $A^0$, $B^0$, $C^0$, and $D^0$ do not depend on any movements or deflections of the casing 12.

As mentioned above, an object of the invention is to determine the position of the cutter device in the soil during the boring step. For this purpose, the position of the casing 12 in the soil is initially determined, and more particularly the position of the top portion of said casing is determined. For this purpose, at least the difference between the fastener point A of the first cable 30 relative to the fixed reference point $A^0$ is measured.

In order to determine more precisely the position of the top portion of the casing, it is preferable also to measure the departures of the fastener points B, C, and D of the other cables relative to the associated fixed reference positions $B^0$, $C^0$, and $D^0$.

In accordance with the invention, the difference between the fastener point A of the first cable relative to the fixed reference point $A^0$ is determined by moving the carriage 50 along the cable between the reference position $A^0$ and the fastener point A. This movement may be downward movement along the cable or it may be upward movement.

During the step of moving the carriage 50 along the first cable 50, the three-dimensional position of the carriage 50 is measured periodically with the help of a locator device. During the movement step, the first cable is held stationary. For this purpose, in this example, downward movement of the casing 12 is stopped.

It can thus be understood that the first cable is stationary while the carriage 50 is moving and taking measurements.

Figure 6:
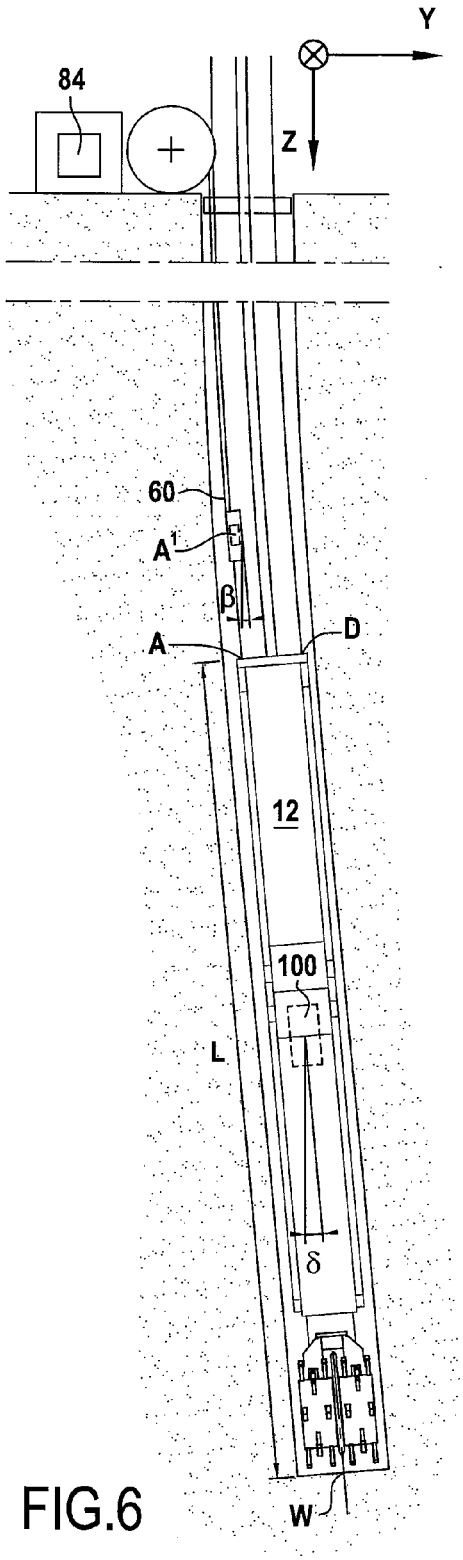
FIG. 6 is a side view of the FIG. 5 casing showing the deflection of the path followed by the casing relative to the vertical in a direction Y parallel to the thickness of the trench.
Figure 5:
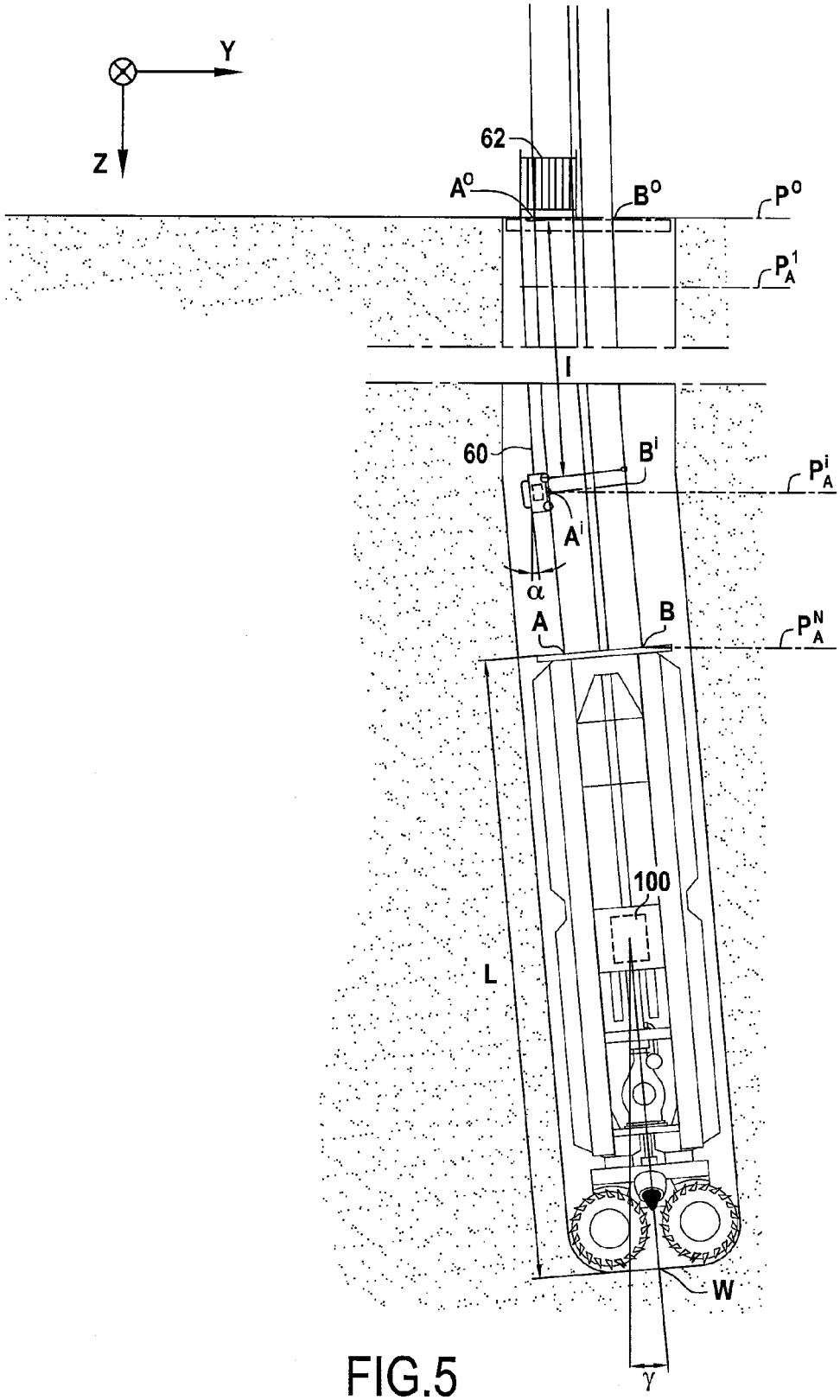
FIG. 5 shows the casing held stationary at great depth in front view, in a vertical plane orthogonal to the thickness of the trench, the path followed by the casing having deflected away from the vertical in a direction X parallel to the width of the trench.
Figure 7A:
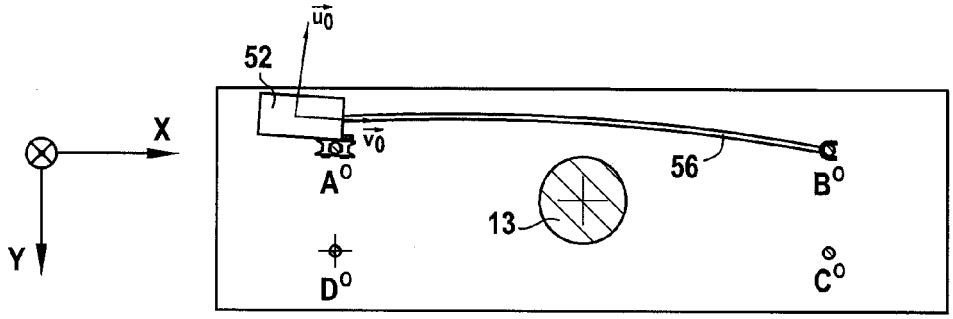
FIGS. 7A to 7D show the position of one of the cables of the casing of FIGS. 5 and 6 in horizontal planes situated at different depths at which the position of the carriage is determined.
Figure 7B:
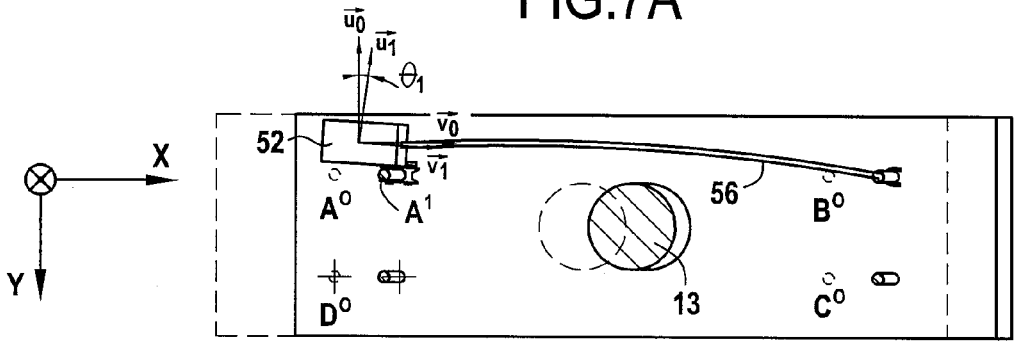
Figure 7C:
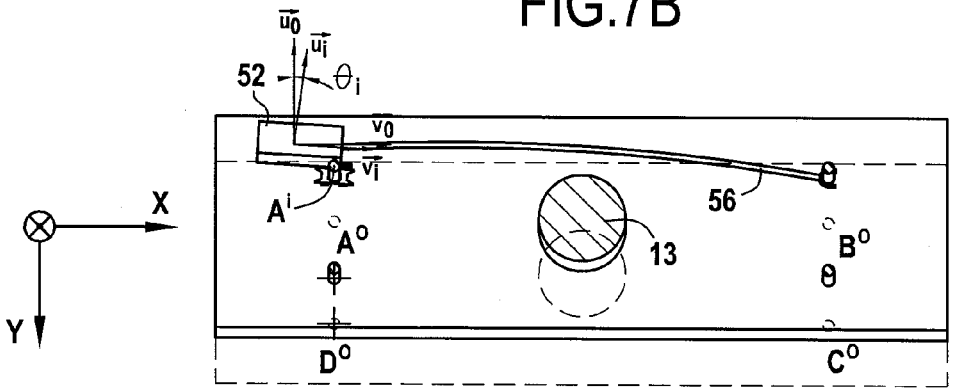
Figure 7D:
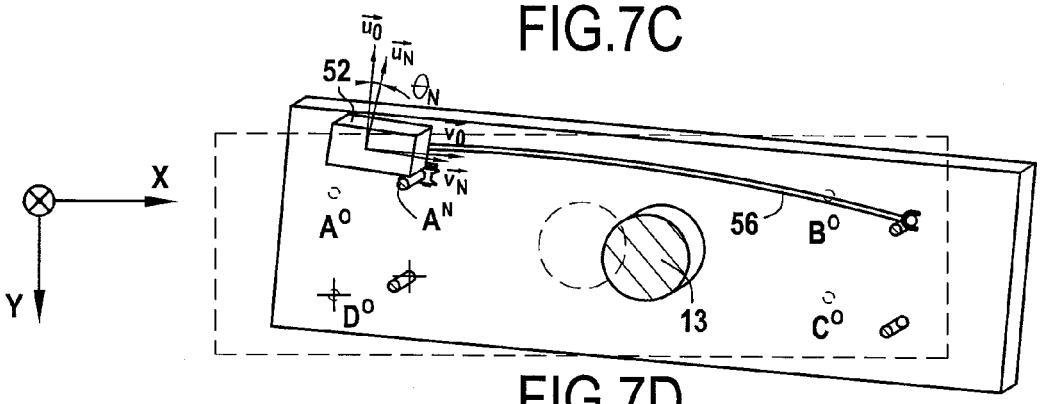

With reference to FIGS. 5 and 6, it can be understood that at an instant t, when a three-dimensional position measurement is performed, the position of the carriage 50 on the first cable 30 is written $A^i$, where i is an integer in the range 1 to N. In this example, N measurements of the three-dimensional position of the carriage are thus taken. The N positions of the carriage, at which measurements are taken, are referred to as measurement points and they are distributed along the first cable. Consequently, the measurement point $A^N$ preferably coincides with the fastener point A, or is at least situated in the immediate vicinity of said fastener point. The carriage 50 is preferably stopped at each measurement point $A^i$ so that the carriage is not moving while the measurement is being taken, thus making it possible to obtain measurement values that are more accurate.

The locator device comprises firstly first and second tilt measurement devices 80 and 82 arranged in the carriage 50 and suitable for measuring tilt angles in two mutually perpendicular vertical planes. These tilt measurement devices, specifically inclinometers, serve to measure:

- a tilt angle $\alpha$ relative to the vertical, this angle corresponding to a rotation of the carriage 50 about the axis Y, as shown in FIG. 5; and
- a tilt angle $\beta$ relative to the vertical, this angle corresponding to a rotation of the carriage 50 about the axis X, as shown in FIG. 6.

When the casing is purely vertical, it can be understood that the carrier cables are likewise vertical, and that as a result the tilt angles $\alpha$ and $\beta$ are zero.

It can also be understood that when the casing deflects from its vertical path, the carrier cables tend to tilt and to curve, as shown in FIGS. 1, 5, and 6, thereby having the effect that the casing tilts relative to the vertical direction. Under such circumstances, at least one of the angles $\alpha$ and $\beta$ is non-zero.

The values of the tilt angles $\alpha$ and $\beta$ as measured at a point $A^i$ are written $\alpha^i$ and $\beta^i$. Thus, at each measurement point $A^i$, with the carriage preferably being stopped, the angles $\alpha^i$ and $\beta^i$ are measured. The tilt angles $\alpha^i$ and $\beta^i$, where i=1 . . . N as measured during the movement of the carriage are stored, in this example, in a memory 51 arranged in the carriage 50.

The locator device comprises secondly a device 84 for determining the length l of the movement of the carriage along the first cable 30. This length l corresponds to the length l of the connection cable 60 that has been unwound from the drum 62. The device 84 naturally enables an infinitesimal movement $\Delta l^i$ of the carriage 50 to be measured between two successive measurement points $A^{i-1}$ and $A^i$. The value of the movement $\Delta l^i$ may be selected as being a constant value $\Delta l$ determined by the drum 62. In a variant, the movement $\Delta l^i$ is measured by means on board the carriage.

In this example, the travel speed of the carriage is controlled. It is preferable for the speed at which the carriage moves up or down to be constant, and to lie in the range 1 meter per second (m/s) to 10 m/s.

In the variant shown, the locator device also has a device 86 for measuring the angle of rotation $\Theta^i$ of the carriage 50 in a substantially orthogonal plane perpendicular to the cable, relative to a reference angular position $\Theta^0$. In this example, the angle of rotation $\Theta$ is measured in a horizontal plane. Because of the presence of the arm 56, the angle of rotation $\Theta$ corresponds to the twist angle of the cable relative to a straight line passing through the reference points $A^0$ and $B^0$. The angle of rotation $\Theta^i$ is preferably measured at each measurement point $A^i$, and in particular at the final position $A^N$ in order to obtain an estimate of the rotation of the top portion of the casing relative to the reference straight line passing through the reference positions $A^0$ and $B^0$. The angles of rotation $\Theta^i$ are stored in the memory S1 of the carriage.

Figure 8:
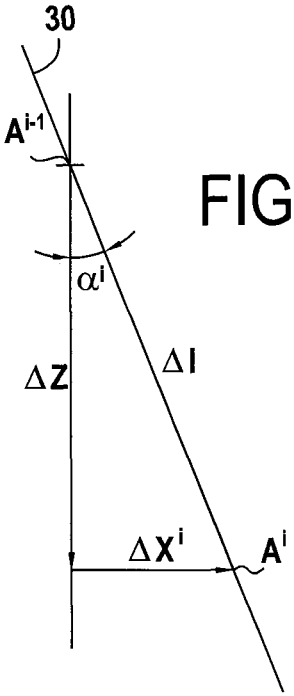
FIG. 8 shows the movement of the carriage along the axis X between two successive measurements.
Figure 9:
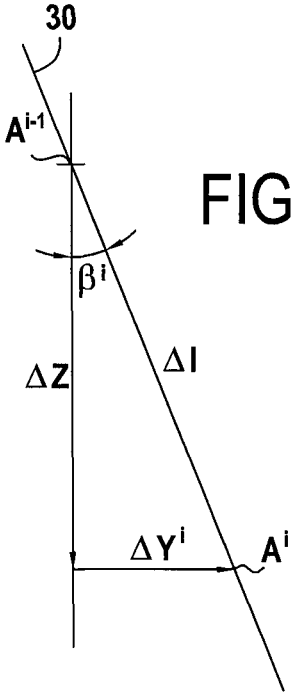
FIG. 9 shows the movement of the carriage along the axis Y between two successive measurements.

With reference now to FIGS. 8 and 9, it can be understood that the values $\alpha^i$ and $\beta^i$, $\Theta^i$, and $\Delta l^i$ enable infinitesimal movements $\Delta X_A{}^i$ and $\Delta Y_A{}^i$ to be determined along the axes X and Y by trigonometric calculation. These movements $\Delta X_A{}^i$ and $\Delta Y_A{}^i$ are also shown in FIGS. 7A to 7D which are horizontal section views showing a few of the measurement points $A^1$, $A^i$, and $A^N$ of the carriage 50 at which the three-dimensional position of the carriage is measured.

In another advantageous aspect of the invention, the excavator machine also has a device 90 for determining the position of the casing 12 from the measurement data, i.e. the values $\alpha^i$, $\beta^i$, and $\Theta^i$ taken by the first and second tilt measurement devices 80, 82 of the locator device and by the device 86 for measuring the twist of the cables during the movement of the carriage along the first cable 30.

In this example, the device 90 has mathematical processor means enabling the above-mentioned movements $\Delta X_A{}^i$ and $\Delta Y_A{}^i$ to be calculated and then by an integral calculus enabling the movement values $\Delta X_A$ and $\Delta Y_A$ of the point A along the axes X and Y to be determined relative to the fixed reference position $A^0$.

The position of the casing 12, and more particularly the position of its top portion 14, is determined from the movement values $\Delta X_A$ and $\Delta Y_A$, and the depth of the point A can be determined for example from the length of the first cable 30 that has been unwound or with the help of some other type of depth measuring instrument secured to the casing.

The number of measurement points N is selected to be large enough to obtain a result that is accurate, it being understood that the value N may depend on the depth that has been reached by the casing. As non-limiting examples, N may be selected so as to take a measurement once every 0.20 m, 0.5 m, 1 m, or 2 m along the cable.

For this purpose, measurements are preferably taken at fixed time intervals, with the carriage being moved at constant speed.

In order to improve the accuracy of measurements, it is possible to increase the number N of measurement points by taking measurements both while lowering the carriage and also while raising it. It is also possible to perform these steps by causing the carriage 50 to slide along other cables, in order to determine the positions of the points B, C, and D.

In another advantageous aspect of the invention, the excavator machine also has a device 92 for determining the position of the cutter device 18 in the ground, on the basis of the position of the casing, and more particularly on the basis of the position of the top portion of the casing 12. The position of the cutter device 18 is also determined from the length (or height) L of the casing and from its tilt relative to the vertical.

The tilt of the casing 12 is measured using an inclinometer 100 arranged in the casing 12 and measuring a first tilt angle $\gamma$ relative to the vertical, as shown in FIG. 5, and a second tilt angle $\delta$ relative to the vertical, as shown in FIG. 6. The first and second tilt angles are measured in two vertical planes that are mutually orthogonal.

The position of the cutter device 18 relative to the points A, B, C, and D is known, so knowledge of the positions of the points A, B, C, and D of and the tilt of the casing makes it possible to calculate, for example, the position of a middle point W situated between the leading edges of the rotary drums.

In order to improve measurement accuracy, account is also taken of the angle of rotation $\Theta$ of the top portion of the casing 12.

Figure 11:
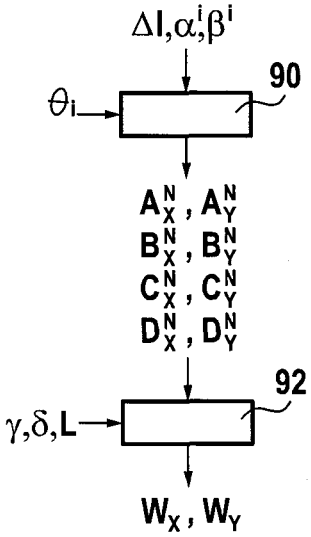
FIG. 11 is a diagram showing the mathematical processing of the signals used for determining the position of the cutter device of the casing in the ground.

In FIG. 11, the mathematical processing of the information delivered by the various above-mentioned measurement devices is shown diagrammatically and serves to calculate the position of the middle point W of the cutter device.

The device 90 for determining the position of the casing 12 receives the values $\alpha^i$ and $\beta^i$, and also $\Theta^i$ as measured during the movement of the carriage by the inclinometers arranged in the carriage, and $\Delta l^i$ as measured by the device 84 for determining the distance the carriage has moved along the first cable 30. The device 90 calculates the coordinates of the points A, B, C, and D. In order to determine the position of the cutter device, the device 92 receives the coordinates of at least one fastener point A, together with the values of the first and second casing tilt angles $\gamma$ and $\delta$ as provided by the inclinometer 100 secured to the casing. The device 92 then provides the coordinates of the middle point W.

During boring, several steps are performed of moving the carriage with the casing 12 at different depths for the purpose of determining a plurality of positions of the casing and of the cutter device, thus making it possible to obtain the real path followed by the casing, and by the cutter device, in the soil S.

Comparing the real path followed with the (desired) path predetermined for the casing, makes it possible to determine the offset or the deflection of the path followed by the casing. This offset can be minimized during boring by actuating path corrector means, e.g. hydraulic pads 110 arranged on the faces of the casing. These pads 110 bear against the walls of the trend, thereby enabling the tilt of the casing to be modified, and thus enabling its path to be modified.

The invention claimed is:

1. An excavator machine comprising:

a suspended casing having a top end and a bottom end;

at least one cable extending above the casing, said cable being under tension and having a bottom end fastened to the top end of the casing;

a cutter device arranged at the bottom end of the casing;

wherein the excavator machine further comprises:

a carriage that is mounted to slide along the cable;

a device for moving the carriage along the cable; and a locator device for determining a three-dimensional position of the carriage.

2. The excavator machine according to claim 1, further comprising:

a guide device for preventing the carriage from pivoting about the cable as the carriage moves along said cable.

3. The excavator machine according to claim 2, wherein the casing is fastened to the bottom end of a first cable and to the bottom end of a second cable, wherein the carriage is mounted to slide along the first cable, and wherein the guide device comprises at least one arm secured to the carriage and co-operating at least with the second cable.

4. The excavator machine according to claim 3, wherein the arm has a distal end that co-operates with the second cable.

5. The excavator machine according to claim 4, further comprising:

an extractor pipe for extracting cuttings, wherein the extractor pipe extends above the casing, and wherein the arm is curved so as to be spaced apart from the extractor pipe.

6. The excavator machine according to claim 1, wherein the locator device includes at least one device for measuring a tilt of the carriage, wherein the at least one device for measuring the tilt is arranged in the carriage.

7. The excavator machine according to claim 6, wherein the locator device has first and second devices for measuring the tilt of the carriage, wherein the first and second devices for measuring the tilt are arranged to measure tilt angles in two mutually perpendicular vertical planes.

8. The excavator machine according to claim 6, wherein the locator device further comprises a device for measuring an angle of rotation of the carriage in a plane substantially perpendicular to the cable.

9. The excavator machine according to claim 1, wherein the carriage has a memory for storing data measured by the locator device during a movement of the carriage.

10. The excavator machine according to claim 1, wherein the locator device further comprises a device for determining a length of a movement of the carriage along said cable.

11. The excavator machine according to claim 1, wherein the device for moving the carriage comprises a connection cable fastened to the carriage.

12. The excavator machine according to claim 1, wherein the device for moving the carriage is configured so that the downward and/or upward speed of the carriage along the cable is controlled.

13. The excavator machine according to claim 1, further comprising:

a device for determining a position of the casing from measurement data taken by the locator device during a movement of the carriage along the cable.

14. The excavator machine according to claim 13, wherein the casing includes an inclinometer enabling a tilt of the casing to be measured relative to vertical, and wherein the excavator machine also comprises a device for determining a position of the cutter device from the position, a length, and the tilt of the casing.

15. The excavator machine according to claim 1, further comprising:

a guide assembly arranged at a ground surface to hold stationary in a horizontal plane a zone of the cable that lies in said plane while the casing is being lowered, said guide assembly serving, at least at the instants that measurements are taken, to define at least one fixed reference position in three-dimensional relationship with the bottom end of the cable.

16. A method of boring into soil, the method comprising:

providing an excavator machine according to claim 1;

performing a boring step by causing the casing to penetrate into the soil;

performing a step of moving the carriage along the cable, during which step three-dimensional positions of the carriage are measured at different measurement points; and determining a position of the casing in the soil from the three-dimensional position measurements of the carriage.

17. The method according to claim 16, wherein the carriage is held stationary at each measurement point.

18. The method according to claim 16, wherein a tilt of the casing is measured and a position of the cutter device in the soil is determined from the position of the casing and the tilt of the casing.

19. The method according to claim 16, wherein the cable is held stationary prior to performing the step of moving the carriage, and wherein a plurality of steps of moving the carriage are performed during the boring step so as to determine a plurality of positions of the casing in the soil and so as to obtain a real path followed by the casing in the soil.

20. The boring method according to claim 19, wherein the real path followed is compared with a path that is predetermined for the casing in the soil, and the positioning of the casing is corrected during the boring step in order to minimize an offset between the real path and the path that is predetermined.

* * * * *